US006254228B1

(12) United States Patent
Sago

(10) Patent No.: US 6,254,228 B1
(45) Date of Patent: Jul. 3, 2001

(54) IMAGE RECORDING APPARATUS THAT SUPPLIES SOLID INK TO A RECORDING DEVICE

(75) Inventor: Akira Sago, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/263,192

(22) Filed: Mar. 5, 1999

(30) Foreign Application Priority Data

Mar. 9, 1998 (JP) ..... 10-057159

(51) Int. Cl.[7] ..... B41J 2/175
(52) U.S. Cl. ..... 347/88
(58) Field of Search ..... 347/88, 99

(56) References Cited

U.S. PATENT DOCUMENTS 5,030,972 * 7/1991 Miyazawa et al. ..... 347/88
6,010,214 * 1/2000 Sago et al. ..... 347/88
6,053,608 * 4/2000 Ishii et al. ..... 347/88

* cited by examiner

*Primary Examiner*—N. Le
*Assistant Examiner*—Michael Nghiem
(74) *Attorney, Agent, or Firm*—Oliff & Berridge, PLC

(57) ABSTRACT

An image recording apparatus allows a single drive device to drive an ink cartridge conveying unit and ink hammers, thereby reducing the production cost. A drive motor supplies a drive force to rollers that convey ink cartridges and link mechanisms that push solid ink pieces out of ink cartridges. A planetary gear is provided to make it possible to select whether to transmit a drive force from the drive motor to the conveying rollers. Therefore, the apparatus is able to transmit a drive force to the conveying rollers only during conveyance of an ink cartridge, and to prevent transmission of drive force to the conveying rollers when the drive motor drives the link mechanisms, while employing the single drive motor to drive the conveying rollers and the link mechanisms.

20 Claims, 8 Drawing Sheets

IMAGE RECORDING APPARATUS THAT SUPPLIES SOLID INK TO A RECORDING DEVICE

BACKGROUND OF THE INVENTION

1. Field of the invention

The invention relates to an image recording apparatus that uses hot melt ink for recording and, more particularly, to a technology for supplying a solid piece of ink from an ink cartridge, which houses a plurality of solid ink pieces, to a recording device.

2. Description of the Related Art

In a conventional image recording apparatus, ink that assumes a solid state at normal temperatures is heated and melted by a recording device, and ink melt is ejected to a recording medium by the recording device. Such an image recording apparatus is mainly used for recording on a large-size recording medium.

When the remaining amount of solid ink becomes short, the aforementioned conventional image recording apparatus produces an alarm, to indicate to an operator that the ink supply is dwindling. Thus, the conventional image recording apparatus is subject to a problem regarding ease of operation.

SUMMARY OF THE INVENTION

The invention is intended to solve the aforementioned problem in operability. It is an object of the invention to provide an image recording apparatus having a single drive device that drives both an ink cartridge conveyance unit and an ink hammer, thereby simplifying the structure of the apparatus, and reducing the number of component parts and the production cost.

According to the invention, an image recording apparatus is provided that includes at least one ink cartridge which houses a plurality of solid ink pieces, a recording device that receives one of the plurality solid ink pieces from the ink cartridge and uses the one solid ink piece for recording by melting the one solid ink piece. The apparatus of the invention includes additional devices. Specifically, at least one ink supply device supplies a solid ink piece from the ink cartridge to the recording device by forcing the solid ink piece out of the ink cartridge. A conveyance device either conveys the ink cartridge toward the ink supply device, or conveys the solid ink pieces toward the ink supply device. A drive device drives the conveyance device and the ink supply device.

In the image recording apparatus of the invention, the ink supply device and conveyance device are driven by the single drive device in order to supply a solid ink piece from the ink cartridge to the recording device. That is, the ink supply device and the drive device do not require separate drive devices. Therefore, the number of required component parts is reduced, and the structure is simplified. Furthermore, since the ink supply device and the conveyance device can be operated in concert by controlling the operation of the single drive device, the control of the ink supply device and the conveyance device is simplified.

In the image recording apparatus of the invention, transmission of drive force from the drive device may be changeable between transmission to the conveyance device and transmission to the ink supply device, by a planetary gear.

When the planetary gear is in a state that the planetary gear does not transmit drive force to the conveyance device, but transmits drive force to the ink supply device, an ink supplying operation is performed. When the planetary gear is in an opposite state, that is, a state where the planetary gear does not transmit drive force to the ink supply device, but transmits drive force to the conveyance device, an ink conveying operation is performed.

The image recording apparatus of the invention may also have a structure as described below. That is, the conveyance device conveys a plurality of ink cartridges of ink colors that are arranged side by side, and an ink supply device is provided separately for each of the ink colors of the ink cartridges. One of the ink supply devices provided separately for the ink colors of the ink cartridges is driven in association with, and in correspondence to, an operation of the recording device, so that a solid ink piece of a corresponding ink color is supplied to an ink tank of the recording device.

In this structure, when the recording device is moved to a position corresponding to one of the ink supply devices provided for a solid ink piece of a desired or needed color, that ink supply device is driven in cooperation with a movement of the recording device so that the solid ink piece of the desired color is supplied to the recording device.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
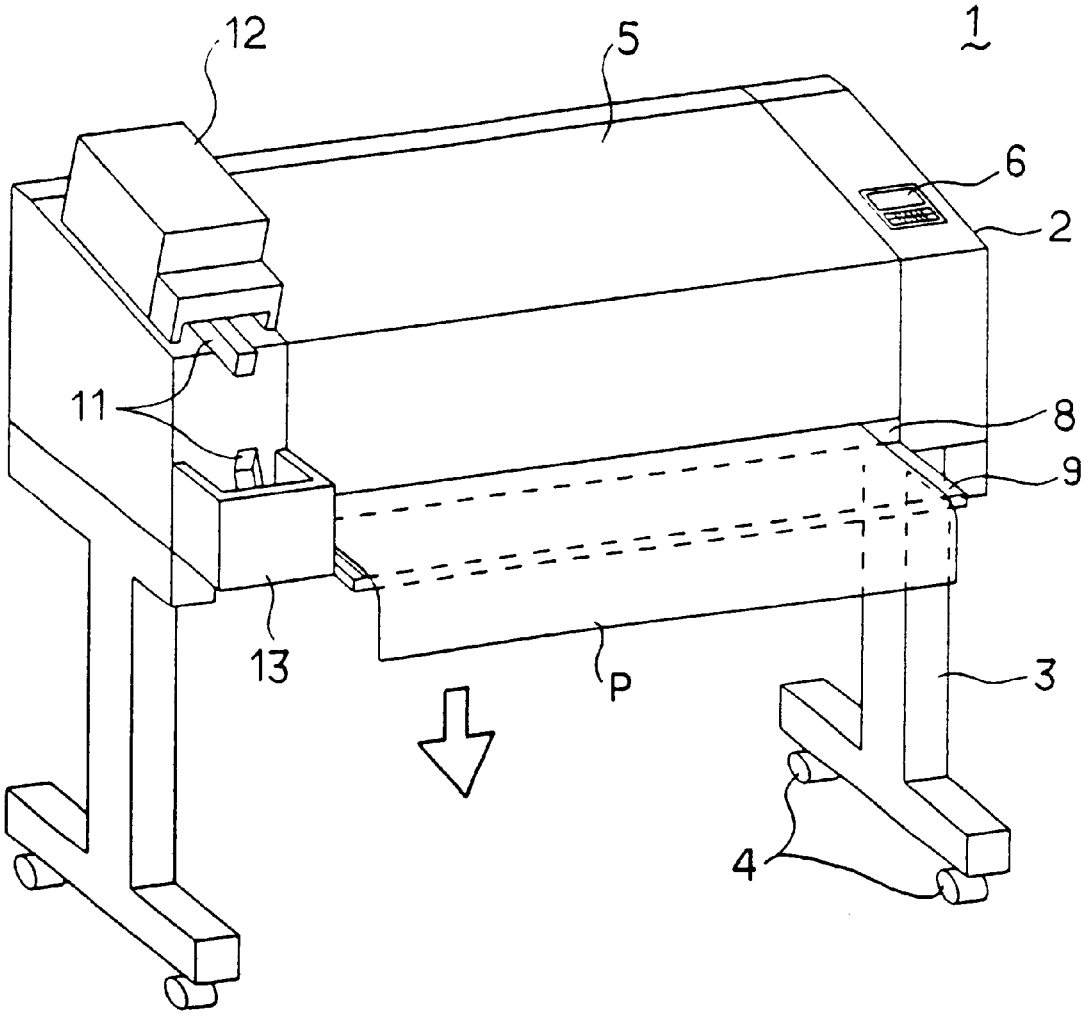
FIG. 1 is a perspective view of an image recording apparatus according to a preferred embodiment of the invention.
Figure 2:
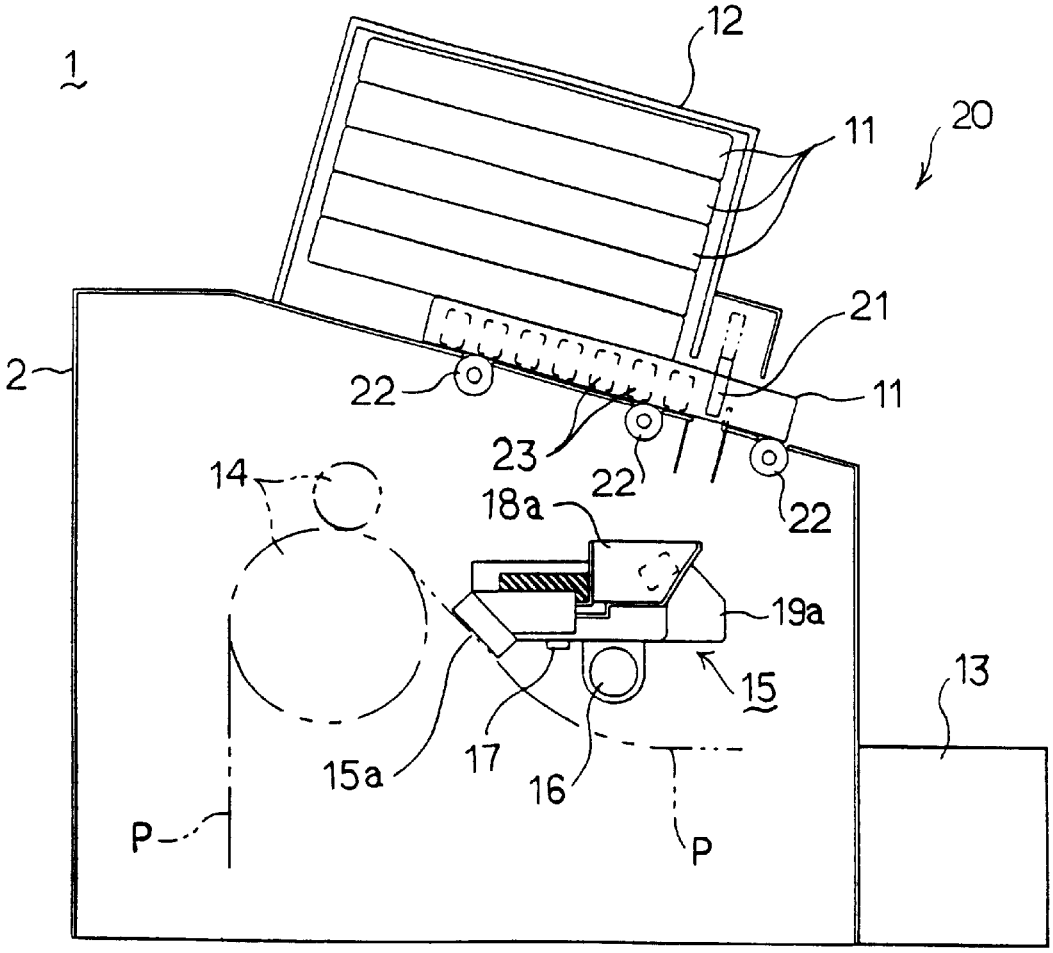
FIG. 2 is a side sectional view of an apparatus body portion of the image recording apparatus shown in FIG. 1.

A preferred embodiment of the invention will be described in detail hereinafter with reference to the accompanying drawings. FIG. 1 is a perspective view of a preferred embodiment of the image recording apparatus of the invention, and FIG. 2 is a side sectional view of an apparatus body of the embodiment shown in FIG. 1.

An image recording apparatus 1 is a large-size printer capable of recording an image on a large-size recording sheet, for example, a recording sheet P fed from a roll having a width of the A0 size, wherein the length of the recording sheet P can be set to a desired length. To record an image on a recording sheet, the image recording apparatus 1 employs an ink jet-type recording head that uses hot melt ink. The image recording apparatus 1 includes an apparatus body 2, and support legs 3 supporting the apparatus body 2. Each support leg 3 has casters 4, so that the image recording apparatus 1 is movable.

The apparatus body 2 has, at its upper face portion, a main cover 5 that can be opened to provide maintenance of a recording mechanism disposed inside the apparatus body 2, and an operating panel 6 provided with various operating switches. Formed in a front lower portion of the apparatus body 2 is a discharge opening 8 that discharges the recording sheet P. Connected to the apparatus body 2 below the discharge opening 8 is a sheet table 9 that temporarily supports the recording sheet P discharged from the discharge opening 8. A housing case 12 that houses a plurality of ink cartridges 11 is provided on the upper face of the apparatus body 2. A recovery case 13 that receives ink cartridges 11 discharged from the housing case 12 is provided on the front face of the apparatus body 2. Each cartridge 11 contains a plurality of solid ink pieces that are used for recording by a recording head portion.

Disposed in the image recording apparatus 1 are sheet conveying rollers 14 that convey the recording sheet P. A recording unit (recording device) 15 that performs recording by ejecting ink from a nozzle portion 15*a* to the recording sheet P is provided at a position that faces the recording sheet P that is being conveyed by the conveying rollers 14. The recording unit 15 is disposed on a guide member 16 extending parallel to the sheet conveying rollers 14, in such a manner that the recording unit 15 is movable in horizontal lateral directions. The recording unit 15 is moved by a drive force that is transmitted to a portion 17 thereof from a drive device (not shown) via a timing belt. The recording unit 15 has ink tanks 18*a*–18*d* (only the ink tank 18*a* is shown in FIG. 2) that receive solid ink pieces. Corresponding to the ink tanks 18*a*–18*d*, protrusions 19*a*–19*d* (only the protrusion 19*a* is shown in FIG. 2) are protruded from a tail end portion of the recording unit 15, the tail end portion being opposite from the nozzle portion 15*a*. The protrusions 19*a*–19*d* are provided to facilitate cooperation between the recording unit 15 and an ink supply mechanism 20 described below.

The ink supply mechanism 20 that supplies solid ink pieces 23 from the ink cartridges 11 is provided above the recording unit 15. The ink supply mechanism 20 includes ink hammers (ink supply devices) 21, each of which drops the solid ink pieces 23 that are housed in an ink cartridge 11, one at a time, from the ink cartridge 11 into the corresponding one of the ink tanks 18*a*–18*d* of the recording unit 15, and cartridge conveying rollers (conveyance device) 22 that convey ink cartridges 11 toward the ink hammers 21. The color (cyan, magenta, yellow and black) ink cartridges 11 that provide color recording are disposed in the housing case 12 in such a manner that the ink cartridges 11 of each color are stacked in vertical directions, and ink cartridges 11 of the different colors are arranged side by side in lateral directions relative to the apparatus body 2. The ink hammers 21 and the conveying rollers 22 are provided individually for each of the four ink colors, although only one ink hammer 21 and only three conveying rollers 22 are shown in FIG. 2.

Figure 3:
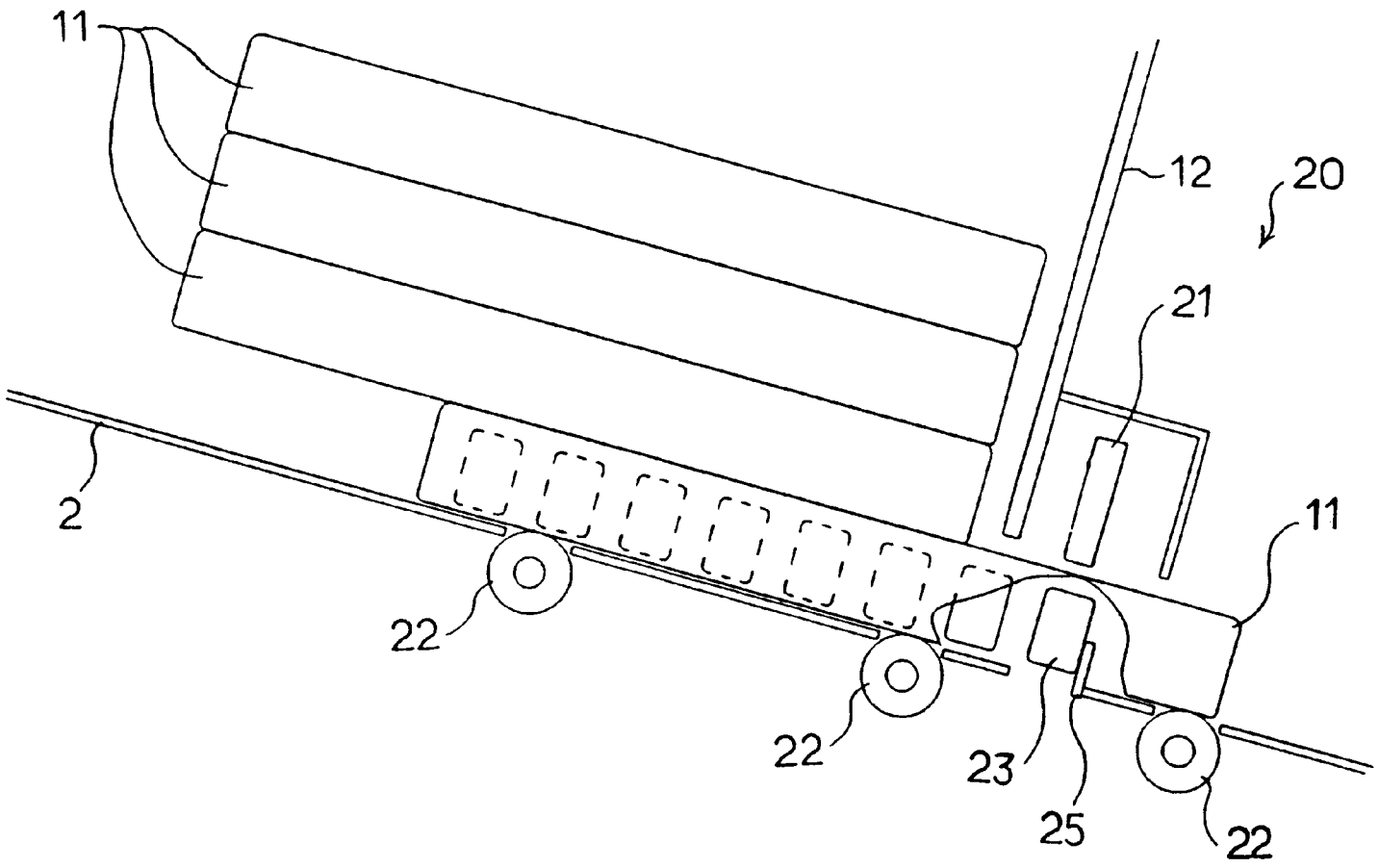
FIG. 3 is a side view of an ink supply mechanism of the image recording apparatus.
Figure 4:
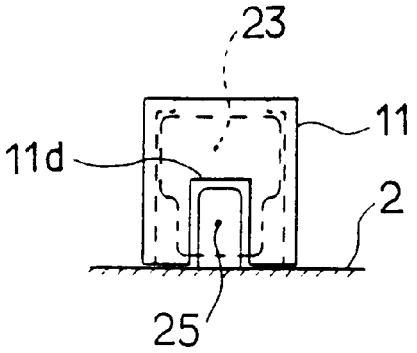
FIG. 4 is a front view of an ink cartridge provided in the ink supply mechanism of the image recording apparatus.

The supply of solid ink pieces to the recording unit 15 performed by the ink supply mechanism will be described with reference to FIGS. 3 and 4. FIG. 3 is a side view of the ink supply mechanism. FIG. 4 is a front view of an ink cartridge 11 provided in the ink supply mechanism.

The lowermost ink cartridge 11 of the ink cartridges 11 of each color stacked in the housing case 12 is conveyed toward the corresponding one of the ink hammers 21 by the corresponding conveying rollers 22. Provided below each ink hammer 21 is an ink stopper 25 protruding from an upper face of the apparatus body 2.

The front-side wall of each ink cartridge 11 has a cutout 11*d* (described in detail below). Therefore, when an ink cartridge 11 is conveyed toward the corresponding ink hammer 21, the corresponding ink stopper 25 extends into the ink cartridge 11 via the cutout 11*d*. As the ink cartridge 11 is further conveyed, the ink stopper 25 contacts the foremost one of the solid ink pieces 23 held in the ink cartridge 11, so that the foremost solid ink piece 23 is appropriately positioned under the ink hammer 21. Each ink hammer 21 is movable up and down by a link mechanism (described below) in cooperation with the recording unit 15.

Figure 5:
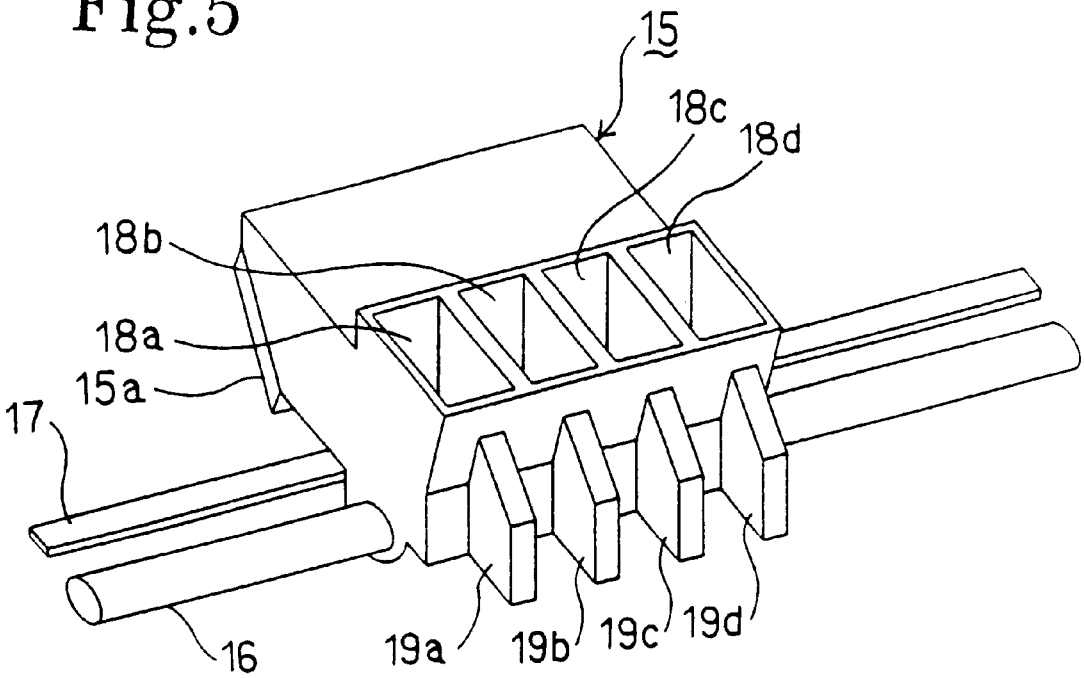
FIG. 5 is a perspective view of a recording unit.

The recording unit 15 will be described with reference to FIG. 5, which is a perspective view of the recording unit 15. The recording unit 15 is provided with ink tanks 18*a*–18*d* disposed side by side, at such positions that each ink tank 18*a*–18*d* can receive a solid ink piece 23 of the corresponding color which is supplied by the ink supply mechanism 20. When a solid ink piece 23 is supplied into the recording unit 15, the solid ink piece 23 is heated to melt, so that liquefied ink is ejected to the recording sheet P. The four protrusions 19*a*–19*d*, corresponding to the ink tanks 18*a*–18*d*, are provided in the tail end portion of the recording unit 15 opposite from the nozzle portion 15*a*. The protrusions 19*a*–19*d* are used to facilitate ink supplying operations performed by the link mechanisms, which are provided corresponding to the ink cartridges 11 of the four ink colors. The cooperation between the protrusions 19*a*–19*d* and the link mechanism will be described below.

Figure 6:
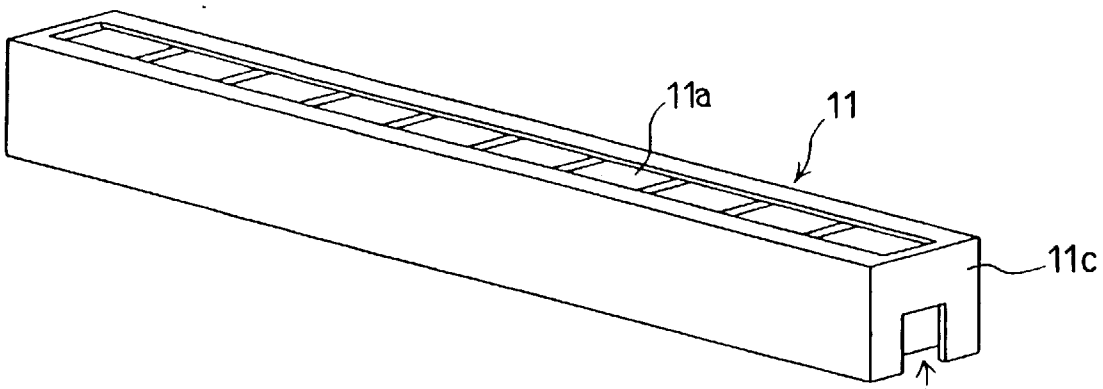
FIG. 6A is a perspective view of an ink cartridge.
FIG. 6B is a side view of the ink cartridge.
FIG. 6C is a bottom plan view of the ink cartridge.
FIG. 6D is a sectional view of the ink cartridge.
Figure 6:
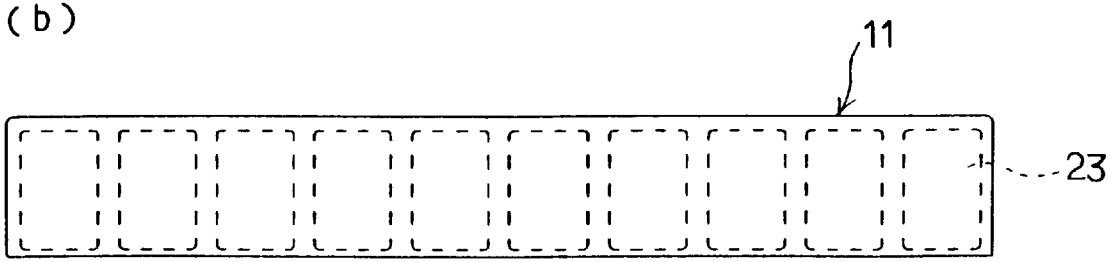
Figure 6:
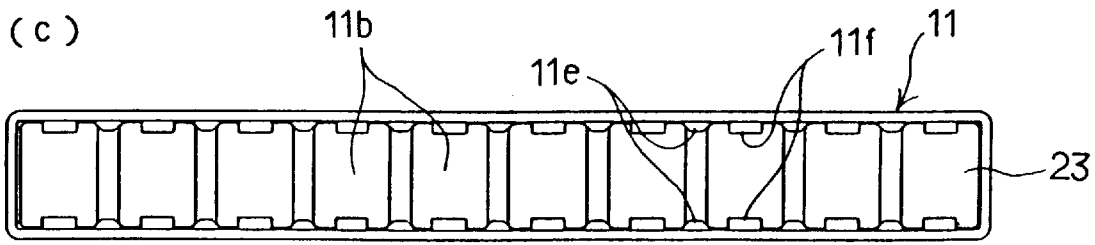
Figure 6:
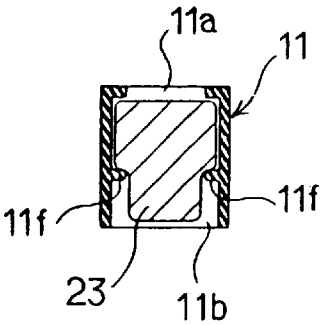

The ink cartridges 11 will be described with reference to FIGS. 6A through 6D. FIG. 6A is a perspective view of an ink cartridge 11, and FIGS. 6B, 6C and 6D are a side view, a bottom plan view and a sectional view thereof, respectively. The ink cartridge 11 has openings 11*a* in its top face and openings 11*b* in its bottom face, so that each solid ink piece 23 housed in the ink cartridge 11 can be pushed from above by the corresponding one of the ink hammers 21 and can be dropped from the ink cartridge 11. An end-side wall 11*c* of the ink cartridge 11 defines the cutout lid, which allows an ink stopper 25 to enter the ink cartridge 11.

When housed in the ink cartridge 11, the solid ink pieces 23 are individually separated by partitions 11*e*. Each of the solid ink piece housing cells partially formed by the partitions lie is provided with stopper portions 11*f* that are formed on the inner surfaces of both side walls, that hold a solid ink piece 23. Each solid ink piece 23 is shaped so as to engage with the stopper portions 11*f*, as shown in FIG. 6D. Due to the engagement with the stopper portions 11*f*, solid ink pieces 23 are retained in the ink cartridge 11. When a solid ink piece 23 housed in the ink cartridge 11 in the above-described manner is pushed from above by the ink hammer 21, the solid ink piece 23 is forced down to become released from the engagement with the stopper portions 11*f*, so that the solid ink piece 23 falls into the corresponding one of the ink tanks 18*a*–18*d* of the recording unit 15.

Figure 7:
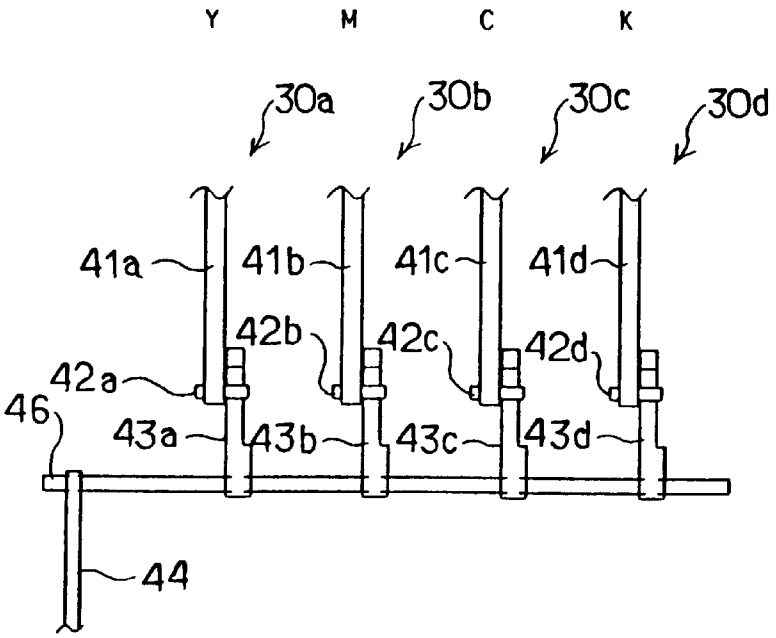
FIG. 7A is a side view of the ink supply mechanism, wherein an ink cartridge is being conveyed.
FIG. 7B is a view of a link mechanism portion of the ink supply mechanism, viewed from a direction indicated by arrow A in FIG. 7A.
Figure 7:
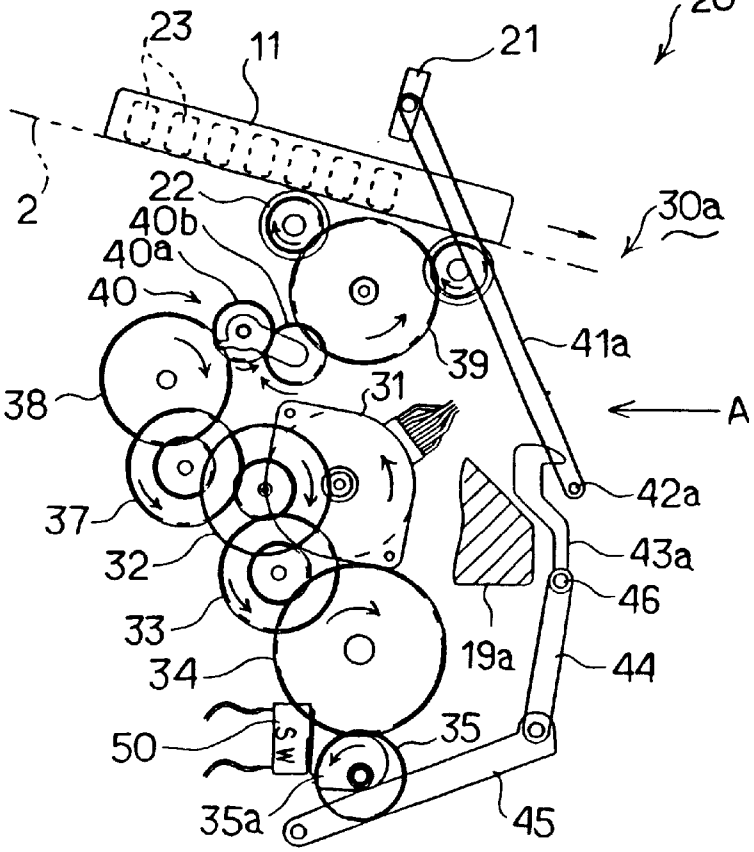

The ink supply mechanism 20 will be described with reference to FIGS. 7A and 7B. FIG. 7A is a side view of the ink supply mechanism 20, where an ink cartridge is being conveyed. FIG. 7B is a view of a link mechanism portion of the ink supply mechanism 20 as viewed from a direction indicated by arrow A in FIG. 7A.

Each ink hammer 21 receives a drive force transmitted from a drive motor (drive device) 31. Link mechanisms (ink supply devices) 30*a*–30*d* that facilitate cooperation between the recording unit 15 and the ink hammers 21 are provided separately for the different ink colors. In this embodiment, the link mechanisms 30*a*–30*d* correspond to yellow (Y), magenta (M), cyan (C) and black (K) inks, respectively.

The drive motor 31 supplies a drive force to the conveying rollers 22 and the ink supply mechanism 20 including the link mechanisms 30*a*–30*d* (only the link mechanism 30*a* is representatively shown in FIG. 7A). The drive force transmission from the drive motor 31 to the link mechanisms 30*a*–30*d* is accomplished by a plurality of gears 32, 33, 34, 35 and a cam 35*a* that is firmly connected to, or formed together with, the gear 35. The drive force transmission from the drive motor 31 to the conveying rollers 22 is accomplished by a plurality of gears 32, 37, 38, 39 and a change-over gear set 40 including a sun gear 40*a* and a planetary gear 40*b*.

The link mechanisms 30*a*–30*d* will be described below. For example, a link mechanism 30*a* corresponding to ink cartridges 11 of one ink color includes a link rod 41*a* connected to the corresponding one of the ink hammers 21, a pull link 43*a* engageable with an engaging protrusion 42*a* formed in an end portion of the link rod 41*a* spaced from the ink hammer 21. The other link mechanisms 30*b*–30*d* corresponding to ink cartridges 11 of the other three colors each include counterparts of the ink hammer 21, the link rod 41*a*, the engaging protrusion 42*a*and the pull link 43*a*of the link mechanism 30*a*, that is, ink hammers 21, link rods 41*b*–41*d*, engaging protrusions 42*b*–42*d*, and pull link 43*b*–43*d*, respectively, although only one ink hammer 21 is shown in the drawings.

The link mechanisms 30*a*–30*d* further include a link rod 44 pivotably connected to the pull link 43*a*–43*d* by a pull link shaft 46, and a link rod 45 pivotably connected to the link rod 44 and pivoted to the apparatus body 2. The pull links 43*a*–43*d* are parallelly and pivotably connected to the single pull link shaft 46, which is pivotably connected to the link rod 44. Therefore, the link rod 44 and the pull links 43*a*–43*d* are pivotably connected via the pull link shaft 46.

The pull links 43*a*–43*d* are hook shaped, as shown in FIG. 7A, so as to readily engage with the protrusions 42*a*–42*d*, respectively. A lower portion of each pull link 43*a*–43*d* is shaped so as to appropriately contact the corresponding one of the protrusions 19*a*–19*d*. The link rod 45 is constantly urged upward to contact the cam 35*a* integrated with the gear 35. The cam 35*a* has such a shape that rotation of the cam 35*a* causes up-down movements of the link mechanisms 30*a*–30*d*. The cam 35*a* is connected to a switch 50 that detects the orientation of the cam 35*a*.

The drive force transmission from the drive motor 31 to the conveying rollers 22 will be described with reference to FIGS. 7A and 7B. As mentioned above, drive force is transmitted from the drive motor 31 to the conveying rollers 22 via the gears 32, 37, 38, 39 and the change-over gear set 40 of the sun gear 40*a* and the planetary gear 40*b*. The change-over gear set 40 is designed to change the state of the planetary gear 40*b* between a state where the planetary gear 40*b* is meshed with the conveying roller-side gear 39 and a state where the planetary gear 40*b* is unmeshed from the conveying roller-side gear 39 in accordance with the operating direction of the drive motor 31. That is, when an ink cartridge 11 is to be conveyed by the conveying rollers 22, the planetary gear 40*b* is meshed with the conveying roller-side gear 39 to transmit drive force from the drive motor 31 to the conveying rollers 22. On the other hand, when a solid ink piece 23 is to be pushed out of the ink cartridge 11 by the corresponding ink hammer 21 (when ink is supplied), the planetary gear 40*b* is unmeshed from the conveying roller-side gear 39 to discontinue the drive force transmission from the drive motor 31 to the conveying rollers 22, that is, to stop the ink cartridge 11 at a predetermined position.

Figure 8B:
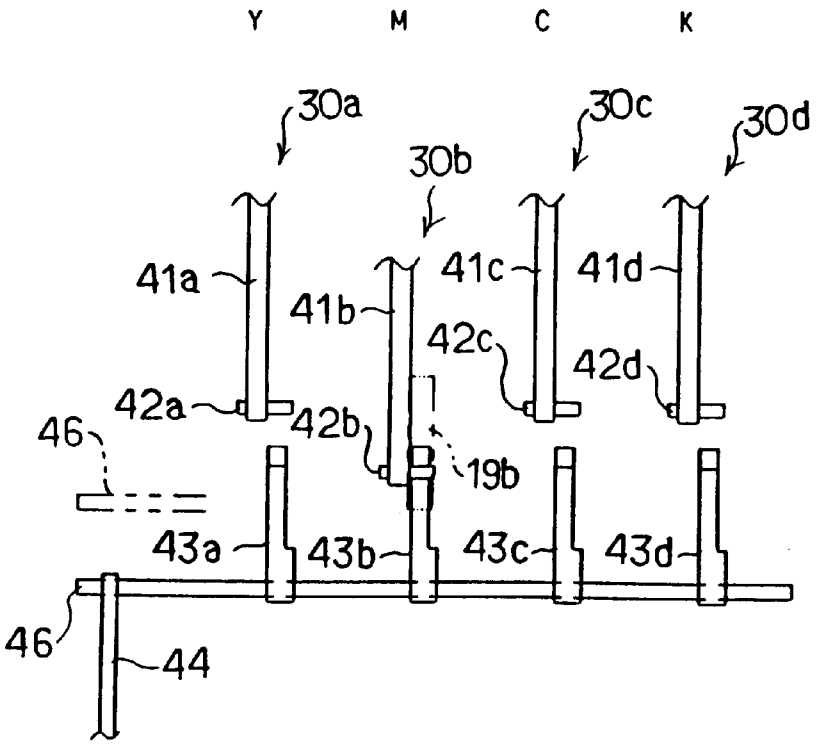
FIG. 8B illustrates the operation of the link mechanisms corresponding to the different ink colors in the situation illustrated in FIG. 8A.
Figure 8A:
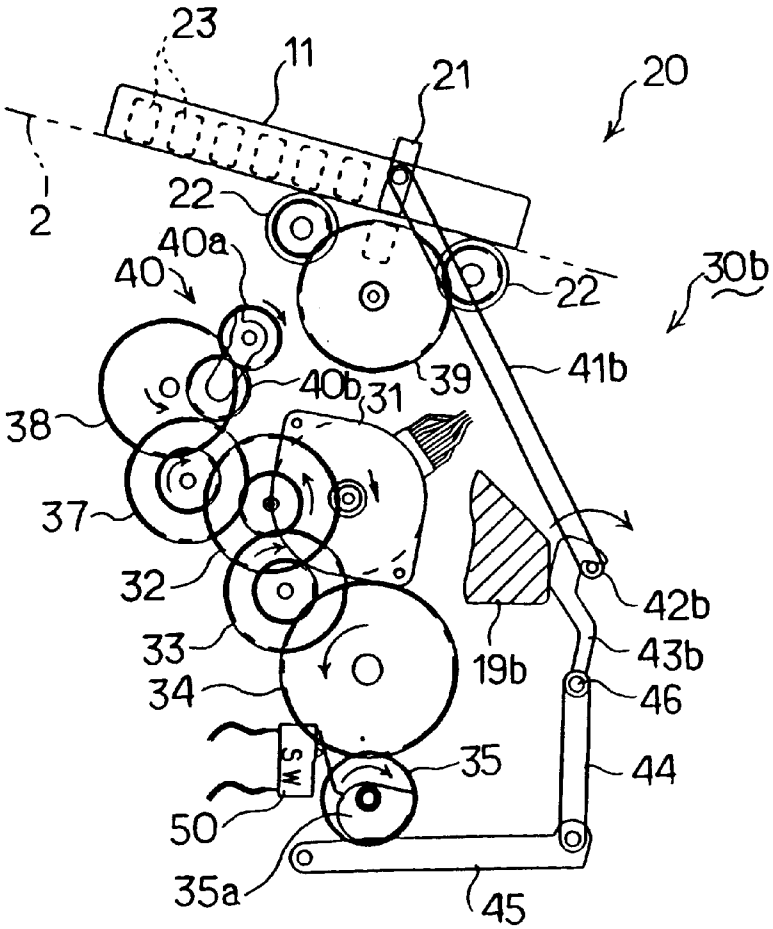
FIG. 8A is a side view of the ink supply mechanism, showing link mechanism corresponding to the color of ink that is about to be supplied.
Figure 9B:
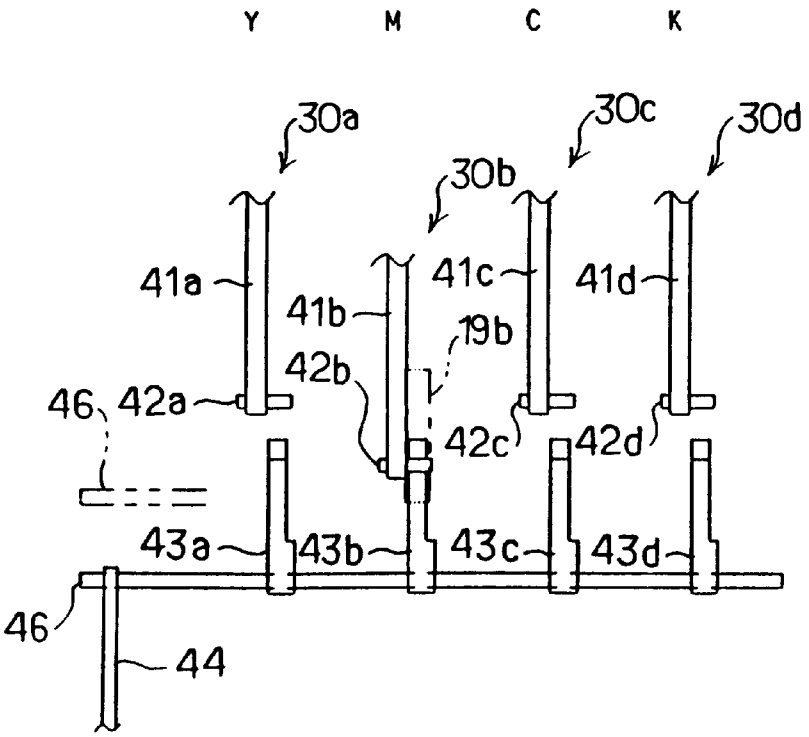
FIG. 9B illustrates the operation of the link mechanisms Corresponding to the different ink colors in the situation illustrated in FIG. 9A.
Figure 9A:
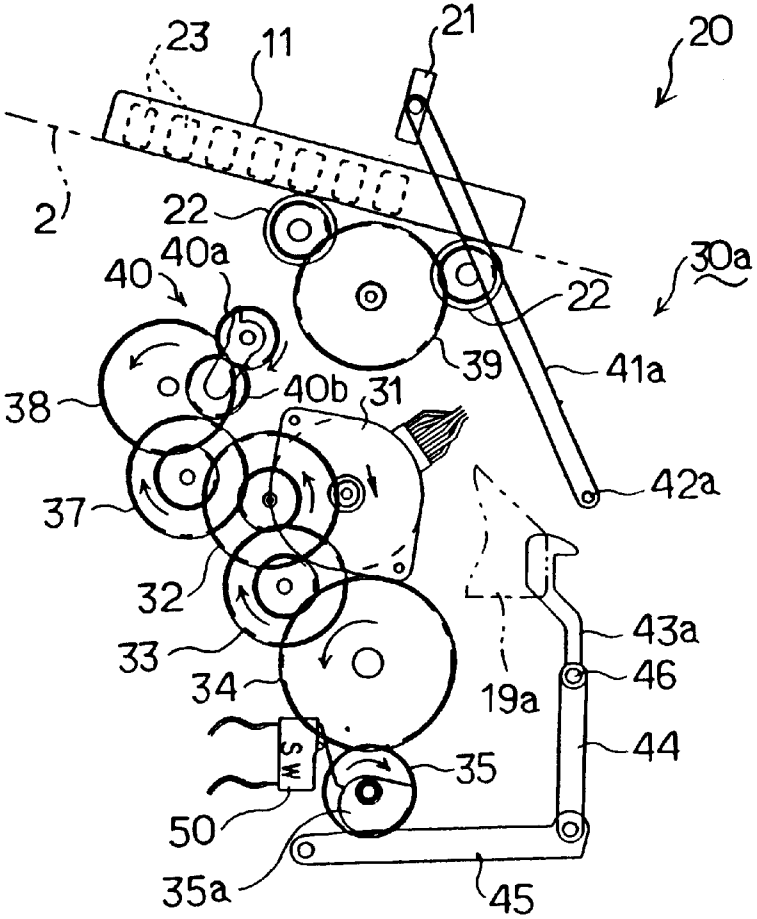
FIG. 9A is a side view of the ink supply mechanism, showing a link mechanism corresponding to the color of ink that is not about to be supplied, while an ink of a different color is about to be supplied.

The ink supplying operation performed by the ink supply mechanism 20 will be described with reference to FIGS. 8A through 9B. FIG. 8A is a side view of the ink supply mechanism, showing a link mechanism corresponding to the color of a solid ink piece that is about to be supplied. FIG. 8B illustrates the operation of the link mechanisms corresponding to the four color inks in the situation illustrated in FIG. 8A. FIG. 9A is a side view of the ink supply mechanism, showing a link mechanism corresponding to the color of a solid ink piece that is not about to be supplied, while a solid ink piece of a different color is about to be supplied. FIG. 9B illustrates the operation of the link mechanisms corresponding to the four color inks in the situation illustrated in FIG. 9A.

To supply a solid ink piece 23 to the recording unit 15, the drive motor 31 is operated in a direction indicated by an arrow in FIG. 8A. In this case, the gears 32, 37, 38 and the sun gear 40*a*, which are disposed between the drive motor 31 and the conveying rollers 22, are rotated in directions indicated by arrows, and the planetary gear 40*b* is moved away from the gear 39 (in a direction indicated by an arrow). Therefore, no drive force is transmitted from the drive motor 31 to the gear 39, so that the conveying rollers 22 do not convey the ink cartridge 11, that is, the ink cartridge 11 remains in position.

The ink cartridge conveyance performed by the ink supply mechanism 20 will be described with reference to FIGS. 7A and 7B. To convey the ink cartridge 11 toward the corresponding ink hammer 21, the drive motor 31 is operated in a direction indicated by an arrow in FIG. 7A, so that the gears 32, 37, 38 and the sun gear 40*a*, which are disposed between the drive motor 31 and the conveying rollers 22, are rotated in directions indicated by arrows, and the planetary gear 40*b* is moved to mesh with the gear 39. Therefore, a drive force is transmitted from the drive motor 31 to the conveying rollers 22 to rotate the conveying rollers 22 in a direction indicated by arrows, thereby conveying the ink cartridge 11 toward the ink hammer 21. During this operation, the cam 35*a* rotates in a direction indicated by an arrow, so that, due to the shape of the cam 35*a*, the ink hammer 21 and the corresponding link mechanism 30*a* are raised and then returned to the lower position. When the switch 50 turns on as the cam 35*a* rotates, the operation of the drive motor 31 is stopped. Through this conveying operation, the ink cartridge 11 is conveyed by a predetermined amount such that the leading-end solid ink piece 23 in the ink cartridge 11 is positioned under the ink hammer 21.

The link mechanisms 30*a*–30*d* operate as follows. When the cam 35*a* rotates in the direction indicated by an arrow in FIG. 8A, the cam 35*a* pushes the link rod 45 down and thereby lowers the pull links 43*a*–43*d*. If one of the protrusions 19*a*–19*d* of the recording unit 15 has been set at such a position that it will contact the pull link of the link mechanism corresponding to the color of ink that needs to be supplied, for example, if the protrusion 19*b* of the recording unit 15 has been set at a position under the pull link 43*b* of the link mechanism 30*b* as shown in FIGS. 8A and 8B, a lower portion of the pull link 43*b* contacts the protrusion 19*b* when the pull link 43*b* is lowered, as described above. As the pull link 43*b* is further lowered together with the other pull links, the pull link 43*b* is pushed by the protrusion 19*b* in a direction indicated by an arrow in FIG. 8A to engage with the engaging protrusion 42*b* of the link rod 41*b*. Due to this engagement, the link rod 41*b* and the corresponding ink hammer 21 are pulled down together with the pull link 43*b*, when the pull link shaft 46 connected to the pull links 43*a*–43*b* is lowered, from a position indicated by a broken line in FIG. 8B, to a position indicated by a solid line in FIG. 8B. As the ink hammer 21 is moved downward in this manner, the leading-end solid ink piece 23 is pushed down from the magenta ink cartridge 11 against the retaining force provided by the stopper portions 11*f* of the ink cartridge 11, so that the solid ink piece 23 falls into the ink tank 19*b*. Solid ink pieces of the other colors can also be supplied to the recording unit 15 by a similar operation.

During the above-described operation, the link mechanisms 30*a*, 30*c*, 30*d* corresponding to the color inks that do not need to be supplied operate as shown in FIGS. 9A and 9B. That is, when the pull links 43*a*, 43*c*, 43*d* are lowered by the cam 35 pushing the link rod 45 down, the pull links 43*a*, 43*c*, 43*d* do not contact the protrusions 19*a*, 19*c*, 19*d* of the recording unit 15. Therefore, the pull links 43*a*, 43*c*, 43*d* are not moved toward the engaging protrusions 42*a*, 42*c*, 42*d*, but simply descend while maintaining their orientations. Since the pull links 43*a*, 43*c*, 43*d* do not engage with the engaging protrusions 42*a*, 42*c*, 42*d*, the corresponding ink hammers 21 are not pulled down, so that solid ink pieces 23 are not supplied from the corresponding ink cartridges 11 to the recording unit 15. The interval or distance between the protrusions 19*a*–19*d* of the recording unit 15 is different from the interval or distance between the engaging protrusions 43*a*–43*d* of the link mechanisms 30*a*–30*d*, so that two or more pull links do not simultaneously contact protrusions of the recording unit 15.

As understood from the above description, in the image recording apparatus 1 of this embodiment, the planetary gear 40*b* is meshed with, or unmeshed from, the conveying roller-side gear 39 in accordance with the operating direction of the drive motor 31. Therefore, by controlling the operating direction of the drive motor 31, it can be selected whether to transmit a drive force from the drive motor 31 to the conveying rollers 22. That is, the image recording apparatus 1 makes it possible to drive the conveying rollers 22 and the ink supply mechanism 20 (including the link mechanisms 30*a*–30*d*), by using only one drive motor. Furthermore, the link mechanisms 30*a*–30*d* are provided separately for the ink colors of ink cartridges 11, and a link mechanism corresponding to an ink cartridge 11 of a desired ink color can be specifically operated by the cooperation between the corresponding one of the protrusions 19*a*–19*d* of the recording unit 15 and the corresponding one of the pull links 43*a*–43*d*. That is, a solid ink piece 23 of a desired color can be supplied to the corresponding one of the ink tanks 18*a*–18*d* of the recording unit 15, in association with an operation of the recording unit 15.

It is to be understood that the invention is not restricted to the particular forms shown in the foregoing embodiment. Various modifications and alternations can be made thereto without departing from the scope of the invention.

For example, although in the foregoing embodiment, the change-over gear set 40 of the sun gear 40*a* and the planetary gear 40*b* is used to switch on and off the drive force transmission to the conveying rollers 22 in order to drive the conveying rollers 22 and the ink supply mechanism 20 (including the link mechanisms 30*a*–30*d*) by using the single drive motor 31, this structure is merely illustrative. It is also possible to use a different change-over mechanism to switch on and off the drive force transmission to the conveying rollers 22.

Furthermore, although in the foregoing embodiment, the ink supply mechanism 20 includes the link mechanisms 30*a*–30*d* in order to enable solid ink pieces 23 of the four colors to be supplied for recording, it is also possible to construct an ink supply mechanism that supplies solid ink pieces of one color for monochrome recording, and therefore includes a link mechanism provided only for ink cartridges containing solid ink pieces of that color.

As understood from the foregoing description, the image recording apparatus of the invention is able to drive the ink supply device and the conveyance device by using a single drive device, so that the structure is simplified in comparison with an apparatus in which drive devices are provided separately for the ink supply device and the conveyance device. Therefore, the production cost can be reduced. Furthermore, since the operation of ink supply device and the operation of the conveyance device can be controlled by controlling the operation of the single drive device, the control of the ink supply device and the conveyance device is simplified.

Furthermore, the drive force transmission from the drive device is changed between the transmission to the ink supply device and the transmission to the conveyance device by using the planetary gear. Therefore, the drive force transmission can reliably be switched by a simple mechanism.

Further, a solid ink piece can be supplied by a corresponding ink supply device in cooperation with a movement of the recording device. Therefore, a solid ink piece of a needed color can be supplied to the recording device simply by controlling the movement of the recording device.

What is claimed is:

1. An image recording apparatus for use with a plurality of solid ink pieces, comprising:

at least one ink cartridge that houses the plurality of solid ink pieces;

a recording device that receives at least one solid ink piece of the plurality of solid ink pieces from the at least one ink cartridge and uses the at least one solid ink piece to perform recording by melting the at least one solid ink piece;

at least one ink supply device that supplies the at least one solid ink piece from the at least one ink cartridge to the recording device by forcing the at least one solid ink piece out of the at least one ink cartridge;

a conveyance device that performs one of conveyance of the at least one ink cartridge toward the at least one ink supply device and conveyance of the at least one solid ink piece toward the at least one ink supply device; and a drive device that drives the conveyance device and the at least one ink supply device by mechanically contacting the conveyance device and the at least one ink supply device.

2. The image recording apparatus according to claim 1, further including a planetary gear, wherein transmission of drive force from the drive device is changeable between transmission to the conveyance device, and transmission to the at least one ink supply device, by the planetary gear.

3. The image recording apparatus according to claim 2, wherein the at least one ink cartridge includes a plurality of ink cartridges, one ink cartridge of the plurality of ink cartridges housing ink of a color different than a color of ink housed in another of the ink cartridges, the plurality of ink cartridges being disposed side by side, the conveyance device conveying the plurality of ink cartridges.

4. The image recording apparatus according to claim 3, wherein the at least one ink supply device includes a plurality of ink supply devices, each ink supply device of the plurality of the ink supply devices being provided for each ink cartridge of the plurality of ink cartridges.

5. The image recording apparatus according to claim 4, wherein the recording device includes an ink tank, and the drive device drives each ink supply device of the plurality of ink supply devices in association with, and in correspondence to, an operation of the recording device, so that a solid ink piece of a specified color is supplied to the ink tank of the recording device.

6. The image recording apparatus according to claim 1, wherein the at least one ink cartridge includes a plurality of ink cartridges, one ink cartridge of the plurality of ink cartridges housing ink of a color different than a color of ink housed in another of the ink cartridges, the plurality of ink cartridges being disposed side by side, the conveying device conveying the plurality of ink cartridges.

7. The image recording apparatus according to claim 6, wherein the at least one ink supply device includes a plurality of ink supply devices, each ink supply device of the plurality of ink supply devices being provided for each ink cartridge of the plurality of ink cartridges.

8. The image recording apparatus according to claim 7, wherein the recording device includes an ink tank, and the drive device drives each ink supply device of the plurality of ink supply devices in association with, and in correspondence to, an operation of the recording device, so that a solid ink piece of a specified color is supplied to the ink tank of the recording device.

9. The image recording apparatus according to claim 1, wherein the at least one ink cartridge includes at least one ink chamber that houses one solid ink piece of the plurality of solid ink pieces, the at least one ink chamber being defined by a pair of side walls so as to form upper and lower apertures, each of the side walls having a protrusion that extends into the at least one ink chamber so as to hold the one solid ink piece within the at least one ink chamber.

10. The image recording apparatus according to claim 9, wherein the at least one ink supply device includes at least one ink hammer that is extendible into the at least one ink chamber via the upper aperture so as to contact the one solid ink piece and thereby force the one solid ink piece out of the at least one ink chamber via the lower aperture.

11. The image recording apparatus according to claim 10, wherein the conveyance device includes a rotatable conveying roller that transmits a rotational force from the drive device to one of the at least one ink cartridge and the one solid ink piece.

12. The image recording apparatus according to claim 11, wherein the drive device includes a drive motor that is rotatable in a clockwise direction and a counterclockwise direction.

13. The image recording apparatus according to claim 12, wherein the drive device includes multiple conveyance gears, that include a planetary gear, and that transmit a rotational force from the drive device to the rotatable conveying roller when the drive motor rotates in one of the clockwise direction and the counterclockwise direction.

14. The image recording apparatus according to claim 13, wherein the drive device includes multiple supply gears, a cam, at least one first link rod and a pull link shaft, wherein the multiple supply gears are operable on the cam to transmit a force to the at least one first ink rod to axially move the pull link shaft.

15. The image recording apparatus according to claim 14, wherein the drive device includes at least one pull link pivotally connected to the pull link shaft and a second link rod connected to the at least one ink hammer, such that upon axial movement of the pull link shaft, the at least one pull link contacts the second link rod which moves the at least one ink hammer into the at least one ink chamber.

16. A method of forming an image with an image recording apparatus with a plurality of solid ink pieces, comprising the steps of:

housing the plurality of solid ink pieces with at least one ink cartridge;

receiving at least one solid ink piece of the plurality of solid ink pieces from the at least one ink cartridge with a recording device;

melting the at least one solid ink piece so as to perform recording with the recording device;

supplying the at least one solid ink piece with at least one ink supply device from the at least one ink cartridge to the recording device by forcing the at least one solid ink piece out of the at least one ink cartridge;

performing with a conveyance device one of conveyance of the at least one ink cartridge toward the at least one ink supply device and conveyance of the at least one solid ink piece toward the at least one ink supply device; and driving the conveyance device and the at least one ink supply device with a drive device by mechanically contacting the conveyance device and the at least one ink supply device.

17. The method according to claim 16, further including the step of changing transmission of drive force from the drive device between transmission to the conveyance device, and transmission to the at least one ink supply device, by a planetary gear.

18. The method according to claim 17, further including the step of driving each ink supply device of a plurality of ink supply devices in association with, and in correspondence to, an operation of the recording device, so that a solid ink piece of a specified color is able to be supplied to the ink tank of the recording device.

19. An image recording apparatus for use with a plurality of solid ink pieces, comprising:

means for housing the plurality of solid ink pieces;

means for receiving at least one solid ink piece of the plurality of solid ink pieces from the at least one ink cartridge;

means for melting the at least one solid ink piece so as to perform recording;

means for supplying the at least one solid ink piece from the at least one ink cartridge to the means for receiving by forcing the at least one solid ink piece out of the at least one ink cartridge;

means for performing one of conveyance of the at least one ink cartridge towards the means for supplying and conveyance of the at least one solid ink piece toward the means for supplying; and means for driving the means for performing and the means for supplying by mechanically contacting the means for performing and the means for supplying.

20. The image recording apparatus according to claim 19, further including means for changing transmission of drive force from the means for driving between transmission to the means for performing and transmission to the means for supplying.

* * * * *